US010375505B2

(12) United States Patent
Fontana et al.

(10) Patent No.: US 10,375,505 B2
(45) Date of Patent: Aug. 6, 2019

(54) APPARATUS AND METHOD FOR GENERATING A SOUND FIELD

(71) Applicants: Huawei Technologies Co., Ltd., Shenzhen (CN); UNIVERSITY OF SOUTHAMPTON, Southampton (GB)

(72) Inventors: Simone Fontana, Munich (DE); Ferdinando Olivieri, Southampton (GB); Filippo Fazi, Southampton (GB); Philip Nelson, Southampton (GB)

(73) Assignees: Huawei Technologies co., Ltd., Shenzhen (CN); UNIVERSITY OF SOUTHAMPTON, Southampton (GB)

( * ) Notice: Subject to any disclaimer, the term of this patent is extended or adjusted under 35 U.S.C. 154(b) by 0 days.

(21) Appl. No.: 16/001,638

(22) Filed: Jun. 6, 2018

(65) Prior Publication Data

US 2018/0288559 A1 Oct. 4, 2018

Related U.S. Application Data

(63) Continuation of application No. PCT/EP2016/065366, filed on Jun. 30, 2016.

(51) Int. Cl.
*H04R 3/12* (2006.01)
*H04S 7/00* (2006.01)
(Continued)

(52) U.S. Cl.
CPC ..... *H04S 7/303* (2013.01); *H04R 1/403* (2013.01); *H04R 3/04* (2013.01); *H04R 3/12* (2013.01); *H04R 5/02* (2013.01); *H04S 7/30* (2013.01)

(58) Field of Classification Search
CPC .... H04S 7/00; H04R 1/40; H04R 3/12; H04R 5/02; H04R 3/04
(Continued)

(56) References Cited

U.S. PATENT DOCUMENTS

2012/0014525 A1* 1/2012 Ko ..... H04S 7/302 381/17
2012/0269368 A1* 10/2012 Horbach ..... H04R 1/26 381/304
(Continued)

FOREIGN PATENT DOCUMENTS

EP 2755405 A1 7/2014

OTHER PUBLICATIONS

Shin et al., "Controlled sound field with a dual layer loudspeaker array," J. Sound Vib., 333(16):3794-3817, Elsevier, (2014).
(Continued)

*Primary Examiner* — Melur Ramakrishnaiah
(74) *Attorney, Agent, or Firm* — Leydig, Voit & Mayer, Ltd.

(57) ABSTRACT

The disclosure relates to an apparatus for generating a sound field on the basis of an input audio signal. The apparatus comprises a plurality of transducers, wherein each transducer is configured to be driven by a transducer driving signal $q_l$ of the respective transducer; a plurality of filters configured to generate for each transducer the transducer driving signal $q_l$ of the respective transducer; and a control unit configured to provide or receive a first transducer driving signal vector $q_0$ of dimension L such that the gradient of $J(q;\psi)$ with respect to q is zero in $(q_0;\psi_0)$, the control unit is further configured to provide a second transducer driving signal vector $\tilde{q}$ of dimension L such that the gradient of the cost function $J(q;\psi)$ with respect to q is [approximately] zero in $(\tilde{q};\tilde{\psi})$, the control unit is configured to provide the second transducer driving signal vector $\tilde{q}$.

14 Claims, 7 Drawing Sheets

(51) Int. Cl.
*H04R 1/40* (2006.01)
*H04R 3/04* (2006.01)
*H04R 5/02* (2006.01)

(58) Field of Classification Search
USPC ..... 381/303, 300; 700/94
See application file for complete search history.

(56) References Cited

U.S. PATENT DOCUMENTS

2015/0043736 A1 2/2015 Olsen et al.
2015/0358756 A1 12/2015 Harma et al.

OTHER PUBLICATIONS

Jiho et al., "Control of sound fields with a circular double-layer array of loudspeakers," In Proceedings of Inter-Noise 2012 Institute of Noise Control Engineering, Technical University of Denmark, (2012).
Betlehem et al., "A constrained optimization approach for multi-zone surround sound", in 2011 IEEE Int. Conf. Acoust. Speech Signal Process., vol. 1, pp. 437-440. Institute of Electrical and Electronics Engineers, New York, New York, (2011).
Cai et al., "Sound reproduction in personal audio systems using the least-squares approach with acoustic contrast control constraint", J. Acoust. Soc. Am. 135 (2), Acoustical Society of America, (2014).
Betlehem et al., "Personal Sound Zones: Delivering interface-free audio to multiple listeners," IEEE Signal Processing Magazine, Institute of Electrical and Electronics Engineers, New York, New York (Feb. 12, 2015).
Fazi et al., "Low frequency performance of circular loudspeaker arrays," In Audio Eng. Soc. Conv. 138, Audio Engineering Society, Warsaw, Poland (May 7-10, 2015).
Olivieri et al., "Pressure-Matching beamforming method for loudspeaker arrays with frequency dependent selection of control points," In AES 138th Conv., Warsaw, Poland, Audio Engineering Society (May 7-10, 2015).
Stewart "Matrix Algorithms: vol. 1: Basic Decompositions," Society for Industrial and Applied Mathematics Philadelphia, PA, (1998).
Wu et al., "Approximate matrix inversion for high-throughput data detection in the large-scale MIMO uplink," Proc.—IEEE Int. Symp. Circuits Syst., (MI): 2155-2158, 2013, Institute of Electrical and Electronics Engineers, New York New York (May 19-23, 2013).
Olivieri et al., "Comparison of strategies for accurate reproduction of a target signal with compact arrays of loudspeakers for the generation of zones of private sound and silence," Article in Journal of the Audio Engineering Society, vol. 64, No. 11, AES, (Nov. 2016).
Olivieri et al., "Generation of private sound with a circular loudspeaker array and the Weighted Pressure Matching method," IEEE/ACM Transactions on Audio, Speech, and Language Processing, 2017 , 25 (8) :1579-1591, Institute of Electrical and Electronics Engineers, New York, New York, (Aug. 2017).

* cited by examiner

Algorithm 1 Iterative algorithm to calculate the input signals.

INPUTS: $\mathbf{Z}$, $\hat{\boldsymbol{\beta}}$, $|p_{B,min}|^2$, $\beta_0$
Initialize: $\psi_D = 1$
Calculate $\mathbf{q}$
while $|\mathbf{z}_B^T\mathbf{q}|^2 < |p_{B,min}|^2$ AND $\psi_D > 0$ do
  $\psi_D = \psi_D - \delta_\psi$
  Calculate $\mathbf{q}$
end while
OUTPUTS: $\mathbf{q}$.

Fig. 2

Algorithm 2 Algorithm to calculate $N$.

```
INPUTS: q̄, q̄_N.
Initialize: N = 0
while ε > ε_MAX do
    N = N + 1
end while
OUTPUTS: N
```

Fig. 4

Algorithm 3 Algorithm for the estimation of $\pm|\Delta\psi_D|$.

INPUTS: $N$, $\mathbf{Z}_B$, $\mathbf{E}$, $\mathbf{q}(\psi_D = 0.5)$, $\psi_D = 0.5$, $p_{B,min}$, $\delta_\psi$
Initialize: $\Delta\psi_{MAX} = 0.5$, $\Delta\psi_{MIN} = -0.5$.
Calculate roots of the polynomial $f(x)$ and keep only the root that satisfies $-0.5 \leq \pm|\Delta\psi_D| \leq 0.5$.
if isempty($|\Delta\psi_D|$) then
    $|\Delta\psi_D| = \psi_{MAX}$
end if
if $f(-0.5) \geq 0$ then
    sign $= -1$
else
    sign $= 1$
end if
$\psi_D = \psi_D + \text{sign} \cdot |\Delta\psi_D|$
OUTPUTS: $\psi_D$.

Fig. 5

APPARATUS AND METHOD FOR GENERATING A SOUND FIELD

CROSS-REFERENCE TO RELATED APPLICATION

This application is a continuation of International Application No. PCT/EP2016/065366, filed on Jun. 30, 2016, the disclosure of which is hereby incorporated by reference in its entirety.

FIELD

Technical Field

The disclosure relates to the field of audio signal processing and reproduction. More specifically, the disclosure relates to an apparatus and a method for generating a sound field.

BACKGROUND

Spatial multi-zone sound field reproduction over an extended region of space has recently drawn increased attention due to its various applications such as simultaneous car entertainment systems, surround sound systems in exhibition centers, personal loudspeaker systems in shared office space, and quiet zones in a noisy environment, where the aim is to provide listeners an individual sound environment without having to use acoustical barriers or headphones. Corresponding systems are also referred to as personal audio or private sound zone (PSZ) systems.

Generally, a sound field can be considered to describe the deviations of the local air pressure from the ambient pressure, i.e. the pressure variations, as a function of space and time caused for instance by the sound signals emitted by a plurality of loudspeakers. A multi-zone sound field usually can comprise one or more acoustically bright zones and possibly several acoustically dark zones as well as grey zones.

Known systems for personal audio are generally based on a performance trade-off between directivity, input energy required by the loudspeaker array to perform directional sound radiation, and accuracy of reproduction of the desired sound field in the listening area, hereafter succinctly referred to as quality. For example, a given system for personal audio may be able to provide high directivity at the expense of a reduced quality in the listening zone, as described, for instance, in the article "Controlled sound field with a dual layer loudspeaker array" by Mincheol Shin, Filippo M Fazi, Philip A Nelson, and Fabio C Hirono, J. Sound Vib., 333(16):3794-3817, August 2014 (hereinafter referred to as Shin et al).

A widely used signal processing method for the design of the input signals to the loudspeaker array is the Pressure-Matching (PM) method. A more general formulation of the PM method is the Weighted-Pressure Matching (WPM) method, which has been used in a number of implementations of known systems for personal audio. In the WPM method, appropriate tunable parameters can be used to design the input signals that provide a desired performance trade-off.

A number of methods have been proposed to control this trade-off that are based on the WPM, such as those proposed in the following articles: Ji Ho Chang and Finn Jacobsen, "Sound field control with a circular double-layer array of loudspeakers", J. Acoust. Soc. Am., 131(6):4518, June 2012; Terence Betlehem and Paul D. Teal, "A constrained optimization approach for multi-zone surround sound", in 2011 IEEE Int. Conf. Acoust. Speech Signal Process., volume 1, pages 437-440. IEEE, May 2011; Yefeng Cai, Ming Wu, and Jun Yang, "Sound reproduction in personal audio systems using the least-squares approach with acoustic contrast control constraint", J. Acoust. Soc. Am., 135(2):734-741, February 2014 as well as the article by Shin et al.

The methods proposed by Chang et Jacobsen and Shin et al. can be considered as "fixed-value parameter" methods, because, in their original formulations, the tunable parameters can be set by the user. The methods proposed by Betlehem and Teal and Cai et al. include on the other hand algorithms for an iterative calculation of the optimal parameters. In this case, these can be referred to as "iterative" methods. The fixed-value parameter methods have the advantage of faster filter calculation (no parameters have to be calculated), but fail to provide an accurate prediction of final performance. On the other hand, iterative methods provide accurate predictions of final performance, but slower filter calculation.

Current systems for private sound zones are designed for a fixed, pre-defined scenario. However, often it might be desirable that a user can rapidly change a scenario. For instance, for a single listener located at a specific point in a given environment, where other people are present, it might be desirable to have a better audio quality as opposed to a highly directive sound, or to change the scenario, i.e. the location and number of the private audio zones.

Thus, there is a need for improved apparatuses and methods for generating a sound field allowing, in particular, for a flexible adaption of the sound field scenario as well as a desired directivity and quality trade-off.

SUMMARY

It is an object of the disclosure to provide improved apparatuses and methods for generating a sound field allowing, in particular, for a flexible adaption of the sound field scenario as well as a desired directivity and quality trade-off.

The foregoing and other objects are achieved by the subject matter of the independent claims. Further implementation forms are apparent from the dependent claims, the description and the figures.

According to a first aspect the embodiment of the disclosure relates to an apparatus for generating a sound field on the basis of an input audio signal, wherein the apparatus comprises: a plurality of transducers, wherein each of the plurality of transducers is configured to be driven by a transducer driving signal $q_l$ of the respective transducer, wherein $l \in \{1, \ldots, L\}$ and wherein l denotes the Z-th transducer; a plurality of filters configured to generate for each transducer the transducer driving signal $q_l$ of the respective transducer, wherein each of the plurality of filters is defined by a filter transfer function and wherein the transducer driving signal $q_l$ of the respective transducer is based on the filter transfer function of the respective transducer and the input audio signal; and a control unit configured to provide or receive a first transducer driving signal vector $q_0$ of dimension L such that the gradient of $J(q;\psi)$ with respect to q is zero in $(q_0;\psi_0)$, wherein $J(q;\psi)$ is a cost function having as variables a transducer driving signal vector q of dimension L and a weight matrix $\psi$ of dimension M×M, and wherein $\psi_0$ is a first weight matrix of dimension M×M, wherein the control unit is further configured to provide a second transducer driving signal vector $\tilde{q}$ of dimension L such that the gradient of the cost function $J(q;\psi)$ with respect to q is approximately zero in $(\tilde{q};\tilde{\psi})$, wherein $\tilde{\psi}$ is a second weight matrix of dimension M×M, and wherein the control unit is configured to provide the second transducer driving signal vector $\tilde{q}$ on the basis of: the first transducer driving signal vector $q_0$, the first weight matrix $\psi_0$, and the second weight matrix $\tilde{\psi}$.

Thus, an improved apparatus for generating a sound field is provided allowing, in particular, for a flexible adaption of the sound field scenario as well as a desired directivity and quality trade-off. For instance, the apparatus according to the first aspect can be reconfigured in real-time by the user to adapt to the changes in the environment (location of the private sound zones), while allowing for control of the directivity/quality performance trade-off.

In a first implementation form of the apparatus according to the first aspect as such, the cost function is given by the following equation:

$$J(q;\psi)=\|\hat{\psi}(\hat{p}-p)\|^2+\beta\|q\|^2.$$

wherein $\hat{p}$ is a target pressure vector of dimension M comprising M target pressure values $\hat{p}_m$ for a set of M control points, $m\in\{1, \ldots, M\}$, p is a pressure vector of dimension M comprising M pressure values $p_m$ for the set of M control points, $m\in\{1, \ldots, M\}$, and β is a regularization parameter in the range of $[0,\infty)$.

In a second implementation form of the apparatus according to the first implementation form of the first aspect, the control unit is configured to compute the second transducer driving signal vector $\tilde{q}$ on the basis of a truncated Neumann series of order N on the basis of the following equation:

$$\tilde{q}=\Sigma_{n=0}^{N}(-(Z^H\psi_0Z+\beta I)^{-1}Z^H\Delta\psi Z)^n(q_0+(Z^H\psi_0Z+\beta I)^{-1}Z^H\Delta\psi\hat{p}).$$

wherein Z is a transfer matrix of dimension M×L, I is the identity matrix of dimension L×L, Δψ denotes the difference between $\psi_0$ and $\tilde{\psi}$ and the superscript $^H$ denotes Hermitian transposition.

In a third implementation form of the apparatus according to the second implementation form of the first aspect, the sound field comprises an acoustically bright zone, an acoustically dark zone and an acoustically grey zone and wherein the cost function $J(q;\psi)$ is given by the following equation:

$$\|p_B-\hat{p}_B\|^2+\psi_D\|p_D\|^2+\psi_G\|p_G\|^2+\beta\|q\|^2,$$

and wherein the gradient of $J(q;\psi)$ with respect to q is zero in $(q_0;\psi_0)$ under the constraint that $|\Sigma_{l=1}^{L} Z_{ml}q_l|^2=|p_m|^2\geq|p_{m,min}|^2$ for each $m\in B$ where B is the set of indices of control points in the bright zone and $|p_{m,min}|^2$ is a positive real number associated with the respective desired minimum level of sound energy at a respective control point in the bright zone, wherein $p_B$ denotes a sound pressure at a control point in the bright zone, $\hat{p}_B$ denotes a desired sound pressure at the control point in the bright zone, $p_D$ denotes a respective sound pressure at a plurality of control points in the dark zone, $p_G$ denotes a respective sound pressure at a plurality of control points in the grey zone, $Z_{ml}$ denotes the element in the m-th row and the l-th column of the transfer matrix Z $\psi_D$ denotes a dark zone weighting parameter, $\psi_G$ denotes a grey zone weighting parameter and $p_{B,min}$ denotes a desired minimum level of sound energy at the control point in the bright zone.

In a fourth implementation form of the apparatus according to the third implementation form of the first aspect, the control unit is configured to provide the second transducer driving signal vector $\tilde{q}$ in response to an adjustment of the desired minimum level of sound energy at the control point in the bright zone.

In a fifth implementation form of the apparatus according to the first aspect as such or any one of the first to fourth implementation form thereof, the first transducer driving signal vector $q_0$ is given by the following equation:

$$q_0=(Z^H\psi_0Z+\beta I)^{-1}Z^H\psi_0\hat{p},$$

wherein Z is a transfer matrix of dimension M×L, $\hat{p}$ is a target pressure vector of dimension M, and β is a regularization parameter in the range of $[0,\infty)$.

In a sixth implementation form of the apparatus according to the first or the fifth implementation form of the first aspect, the control unit is configured to determine the regularization factor β on the basis of a normalized Tikhonov regularization.

In a seventh implementation form of the apparatus according to the third implementation form of the first aspect, the truncated Neumann series of order N is defined by the following equation:

$$\Sigma_{n=0}^{N}\Delta\psi_D{}^nE^n,$$

wherein $\Delta\psi_D$ denotes an adjustment of the dark zone weighting parameter $\psi_D$ and wherein the matrix E is defined by the following equation:

$$E=-A^{-1}Z_D{}^HZ_D,$$

wherein the matrix A is defined by the following equation:

$$A=Z_B{}^HZ_B+\psi_DZ_D{}^HZ_D+\psi_GZ_G{}^HZ_G+\beta I,$$

wherein $Z_B$ denotes the transfer matrix for the bright zone, $Z_D$ denotes the transfer matrix for the dark zone, and $Z_G$ denotes the transfer matrix for the grey zone.

In an eighth implementation form of the apparatus according to the seventh implementation form of the first aspect, the control unit is configured to determine the adjustment $\Delta\psi_D$ of the dark zone weighting parameter $\psi_D$ by determining the root of the following equation within the interval $-0.5\leq\Delta\psi_D\leq0.5$:

$$\Sigma_{n=0}^{N}|\Delta\psi_D|^n|z_B{}^TE^nq|-|p_{B,min}|=0,$$

wherein $z_B{}^T$ denotes portion of the transfer matrix defining a vector and $p_{B,min}$ denotes a desired minimum level of sound energy at the control point in the bright zone.

In a ninth implementation form of the apparatus according to the second implementation form of the first aspect, the order N of the truncated Neumann series depends on frequency.

In a tenth implementation form of the apparatus according to the ninth implementation form of the first aspect, the order N of the truncated Neumann series decreases with increasing frequency.

In an eleventh implementation form of the apparatus according to the ninth or tenth implementation form of the first aspect, the control unit is configured to determine the order N of the truncated Neumann series on the basis of the following equation:

$$N=\min_N\{\varepsilon\leq\varepsilon_{MAX}\},$$

wherein $\varepsilon_{MAX}$ denotes an error threshold and ε denotes an error measure defined by the following equation:

$$\varepsilon=10\log_{10}\left(\frac{\|\tilde{q}_N-\tilde{q}\|^2}{\|\tilde{q}\|^2}\right),$$

wherein $\tilde{q}_N$ denotes the transducer driving signal vector determined on the basis of the truncated Neumann series.

In a twelfth implementation form of the apparatus according to the first aspect as such or any one of the first to eleventh implementation form thereof, the apparatus further comprises a memory configured to store the first transducer driving signal vector $q_0$.

According to a second aspect the embodiment of the disclosure relates to a method for generating a sound field on the basis of an input audio signal, wherein the method comprises the steps of: providing or receiving a first transducer driving signal vector $q_0$ of dimension L such that the gradient of $J(q;\psi)$ with respect to q is zero in $(q_0;\psi_0)$, wherein $J(q;\psi)$ is a cost function having as variables a transducer driving signal vector q of dimension L and a weight matrix $\psi$ of dimension M×M, and wherein $\psi_0$ is a first weight matrix of dimension M×M; providing a second transducer driving signal vector $\tilde{q}$ of dimension L such that the gradient of the cost function $J(q;\psi)$ with respect to q is zero in $(\tilde{q};\tilde{\psi})$, wherein $\tilde{\psi}$ is a second weight matrix of dimension M×M, and wherein the second transducer driving signal vector $\tilde{q}$ is provided on the basis of: the first transducer driving signal vector $q_0$, the first weight matrix $\psi_0$, and the second weight matrix $\tilde{\psi}$; and driving each transducer of a plurality of L transducers by a respective component $\tilde{q}_l$ of the second transducer driving signal vector $\tilde{q}$ where $l \in \{1, \ldots, L\}$.

The method according to the second aspect of the embodiment of the disclosure can be performed by the apparatus according to the first aspect of the embodiment of the disclosure. Further features of the method according to the second aspect of the embodiment of the disclosure result directly from the functionality of the apparatus according to the first aspect of the embodiment of the disclosure and its different implementation forms.

According to a third aspect the embodiment of the disclosure relates to a computer program comprising program code for performing the method according to the second aspect of the embodiment of the disclosure or any of its implementation forms when executed on a computer.

The embodiment of the disclosure can be implemented in hardware and/or software.

BRIEF DESCRIPTION OF THE DRAWINGS

Further embodiments of the disclosure will be described with respect to the following figures, wherein:

FIG. 2 shows pseudo-code of a first algorithm implemented in an apparatus for generating a sound field according to an embodiment;

FIG. 4 shows pseudo-code of a second algorithm implemented in an apparatus for generating a sound field according to an embodiment;

FIG. 5 shows pseudo-code of a third algorithm implemented in an apparatus for generating a sound field according to an embodiment;

In the figures, identical reference signs will be used for identical or functionally equivalent features.

DETAILED DESCRIPTION OF EMBODIMENTS

In the following description, reference is made to the accompanying drawings, which form part of the disclosure, and in which are shown, by way of illustration, specific aspects in which the embodiment of the disclosure may be placed. It will be appreciated that the embodiment of the disclosure may be placed in other aspects and that structural or logical changes may be made without departing from the scope of the embodiment of the disclosure. The following detailed description, therefore, is not to be taken in a limiting sense, as the scope of the embodiment of the disclosure is defined by the appended claims.

For instance, it will be appreciated that a disclosure in connection with a described method will generally also hold true for a corresponding device or system configured to perform the method and vice versa. For example, if a specific method step is described, a corresponding device may include a unit to perform the described method step, even if such unit is not explicitly described or illustrated in the figures.

Moreover, in the following detailed description as well as in the claims, embodiments with functional blocks or processing units are described, which are connected with each other or exchange signals. It will be appreciated that the embodiment of the disclosure also covers embodiments which include additional functional blocks or processing units, such as pre- or post-filtering and/or pre- or post-amplification units, that are arranged between the functional blocks or processing units of the embodiments described below.

Further, it is understood that the features of the various exemplary aspects described herein may be combined with each other, unless specifically noted otherwise.

Figure 1:
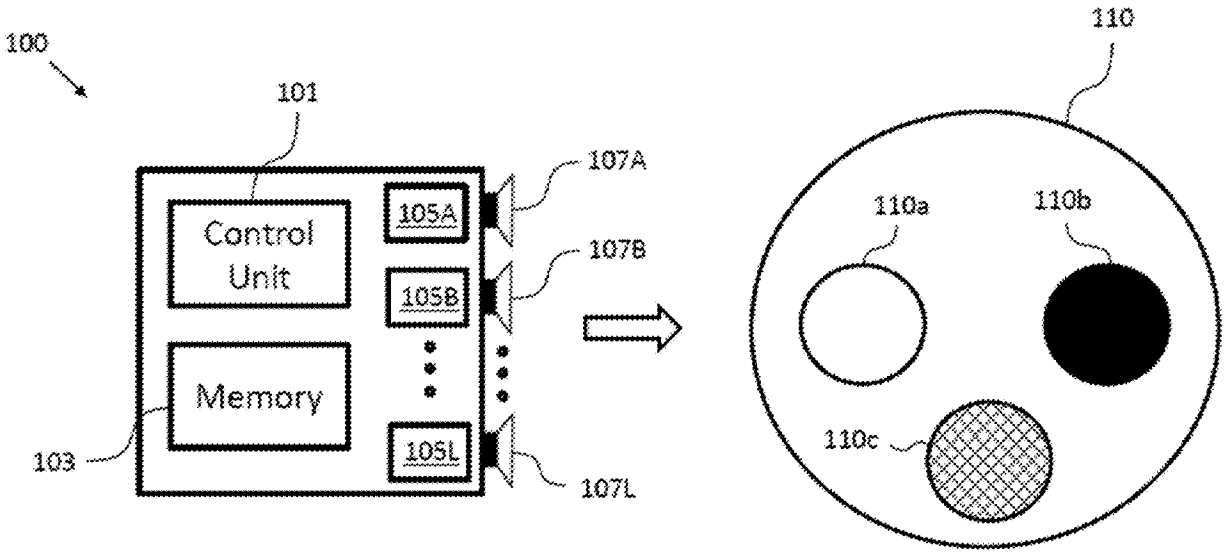
FIG. 1 shows a schematic diagram illustrating an apparatus for generating a sound field according to an embodiment.

FIG. 1 shows a schematic diagram of an apparatus 100 for generating a sound field according to an embodiment. The apparatus 100 shown in FIG. 1 comprises a control unit 101, a memory 103, a plurality of filters 105A-L as well as a corresponding plurality of transducers 107A-L in the form of loudspeakers. Each transducer is configured to be driven by a transducer driving signal $q_l$, wherein $l \in \{1, \ldots L\}$ and wherein l denotes the l-th transducer. The plurality of filters 105A-L are configured to generate for each transducer 107A-L the transducer driving signal $q_l$, wherein each of the filters 105A-L is defined by a filter transfer function and wherein the transducer driving signal $q_l$ of the respective transducer is based on the filter transfer function of the respective transducer and an input audio signal.

As will be described in more detail further below, the control unit 101 is configured (i) to provide or receive a first transducer driving signal vector $q_0$ of dimension L such that the gradient of $J(q;\psi)$ with respect to q is zero in $(q_0;\psi_0)$, wherein $J(q;\psi)$ is a cost function having as variables a transducer driving signal vector q of dimension L and a weight matrix $\psi$ of dimension M×M, and wherein $\psi_0$ is a first weight matrix of dimension M×M, and (ii) to provide a second transducer driving signal vector $\tilde{q}$ of dimension L such that the gradient of the cost function $J(q;\psi)$ with respect to q is zero in $(\tilde{q};\tilde{\psi})$, wherein $\tilde{\psi}$ is a second weight matrix of dimension M×M, and wherein the control unit 101 is configured to provide the second transducer driving signal vector $\tilde{q}$ on the basis of: the first transducer driving signal vector $q_0$, the first weight matrix $\psi_0$, and the second weight matrix $\tilde{\psi}$.

In the embodiment shown in FIG. 1, the apparatus 100 is configured to generate a sound field within a spatial control zone 110. The spatial control zone 110 or sound field can comprise one or more acoustically bright zones 110*a*, one or more acoustically dark zones 110*b* and/or one or more acoustically grey zones 110*c*, as will be described in more detail further below.

Before describing further details and embodiments of the apparatus 100 shown in FIG. 1, some mathematical notation will be introduced. The notation $1_A^T=[1, 1, \ldots, 1]$ defines a vector, where $[\ldots]^T$ indicates a row vector of length A, and the notation $0_B^T=[0, 0, \ldots, 0]$ defines a vector of length B. Given a square matrix Y, $Y^n$ defines the n-times matrix product of the square matrix Y. The acoustical quantities used herein can have a time dependence of $e^{-j\omega t}$, wherein j is the imaginary unit, ω denotes the angular frequency and t denotes time.

In an embodiment, where the plurality of transducers (e.g., also referred to herein as loudspeakers) 107A-L are arranged as a circular array, the l-th loudspeaker can be identified by the vector of coordinates $y_l$, $l\in[-(L-1)/2,(L-1)/2]$ and it is driven by the transducer driving signal $q_l(\omega)$). Thus, the vector of transducer driving signals fed to the loudspeakers 107A-L can be expressed as a transducer driving signal vector $q^T(\omega)=[q_1(\omega), \ldots, q_L(\omega)]$. The resulting acoustic signal (output signal, i.e. the sound pressure generated by the loudspeaker array 107A-L driven with $q^T(\omega)$) at the m-th control point located at $x_m$ (with m=1, . . . , M) is denoted by $p(x_m,\omega)$.

In an embodiment, the control area 110 can include M control points and the vector of the output signals is given by $p^T(\omega)=[p(x_1,\omega), \ldots, p(x_M,\omega)]$. The vectors p(ω) and q(ω) are related by a linear transformation, that is $$p(\omega)=Z(\omega)q(\omega), \tag{1}$$

wherein the plant or transfer (function) matrix Z(ω) of dimensions M×L contains the transfer functions relating the sound pressure at a respective control point to the strength of a respective source, i.e. loudspeaker. For the sake of clarity, the explicit dependence on 0) will be omitted in the further description below.

In private sound zone applications, the control area 110 (and thus the plant matrix) is usually divided into zones where sound is desired or undesired. As already mentioned above, these zones are usually referred to as acoustically bright zone(s) 110*a* and acoustically dark zone(s) 110*b*, respectively. In an embodiment, also an acoustically grey zone 110*c* is considered, that is a portion of the control zone 110 where an accurate reproduction of the target signals is not required. Using the definitions above, the transfer matrix Z can be written in the following way:

$$Z=\begin{bmatrix} Z_B \\ Z_D \\ Z_G \end{bmatrix}, \tag{2}$$

and the corresponding acoustic pressure signals are denoted by $p_B=Z_Bq$, $p_D=Z_Dq$ and $p_G=Z_Gq$, wherein $Z_B$, $Z_D$ and $Z_G$ denote the respective transfer matrix for the control points 111*a-c* in the bright zone 110*a*, dark zone 110*b* and grey zone 110*c*, respectively.

A desired target signal $\hat{p}^T=[\hat{p}(x_1), \ldots, \hat{p}(x_M)]$ defined in magnitude and phase at the M control points within the control zone 110, can be synthesized by driving the array of loudspeakers 107A-L with input signals designed on the basis of the Weighted-Pressure Matching (WPM) method. The target signals in the various acoustic zones (e.g., bright, dark, or gray) are defined as $$\hat{p}_{M\times 1}=\begin{bmatrix} \hat{p}_B \\ \hat{p}_D \\ \hat{p}_G \end{bmatrix}=\begin{bmatrix} 1_{M_B} \\ 0_{M_D} \\ 0_{M_G} \end{bmatrix}. \tag{3}$$

Embodiments of the disclosure are based on a WPM cost function J(q), which is the sum of the squared weighted reproduction error in each zone and an array effort control term, that is $$J(q)=\|\hat{\Psi}(\hat{p}-p)\|^2+\beta\|q\|^2, \tag{4}$$

wherein ‖ . . . ‖ denotes the $l_2$-norm, $\hat{\Psi}$ denotes a M×M diagonal matrix that contains the square roots $\sqrt{\Psi_m}$ of the WPM weights $0\leq\Psi_m\leq 1$ for the reproduction error at the m-th control point, and $\beta\in[0,\infty)$ is referred to as the Tikhonov regularization parameter and it serves to control the input energy to the array of loudspeakers 107A-L. In this disclosure, $\Psi=\hat{\Psi}^2$.

The WPM weight $\Psi_m$ allows to control the weight of the reproduction error at the m-th control point 110*a-c*. Higher values of $\Psi_m$ result in a higher accuracy of reproduction of the target signal at the m-th control point.

The input signals (i.e. transducer driving signals) that minimize the cost function in equation (4) can be found by setting the partial derivative of the cost function J(q) with respect to the real and the imaginary parts of q to zero and solving with respect to q, that is $$q=(Z^H\psi Z+\beta I)^{-1}Z^H\psi\hat{p}.$$

In the following, embodiments of the disclosure will be described for the case of a single control point in the bright zone 110*a*. However, the person skilled in the art will readily appreciate that these embodiments can be readily extended to the case of having more than one control point in the bright zone 110*a*.

For the case of one control point in the bright zone 110*a* the above solution for the vector of transducer driving signals can be written as follows:

$$q=(Z^H\psi Z+\beta I)^{-1}z^*_B\hat{p}_B, \tag{5}$$

wherein $(\bullet)^H$ denotes the operation complex conjugate transpose, $(\bullet)^{-1}$ is the matrix inverse, I denotes the identy matrix and $(\bullet)^*$ denotes the operation of complex conjugate.

For example, by setting $\psi_m=1$ ∀m, wherein the mathematical symbol ∀ has the meaning of "for all values of" one obtains the following solution:

$$q=(Z^HZ+\beta I)^{-1}z^*_B\hat{p}_B. \tag{6}$$

The following definitions will be used in the further description below. A "scenario" is a set of M control points 101*a-c* along with an associated set of M transfer functions, namely the transfer functions $Z_B$ in the bright zone 110*a*, the transfer functions $Z_D$ in the dark zone 110*b*, and the transfer functions $Z_G$ in the grey zone 110*c*. "Audio quality" (or "quality") refers to the accuracy of reproduction of the desired sound field in the listening area, i.e. the bright zone.

Embodiments of the disclosure propose a formulation of the WPM wherein the WPM weight in the quiet zone is determined with respect to the desired quality performance. These embodiments allow the user of the apparatus 100 to control the trade-off between quality and directivity. Let us indicate with $\psi_D$ and $\psi_G$ the WPM weights at the dark and gray points, respectively. As already mentioned above, for the sake of simplicity the following embodiments are directed to only one bright point, i.e one control point in the bright zone 110*a*, with associated pressure $p_B$, which is a scalar.

In order to generate a private sound zone, according to embodiments of the disclosure, the control unit 101 is configured to solve the following set of equations:

$$\|p_B-\hat{p}_B\|^2+\psi_D\|p_D\|^2+\psi_G\|p_G\|^2+\beta\|q\|^2 \tag{7}$$

$$\text{subject to } |Z_B^T q|^2=|p_B|^2\geq|p_{B,min}|^2, \tag{8}$$

wherein $|p_{B,min}|^2$ denotes the desired minimum level of energy in the listening zone 110*a* that is set by the user and controls the minimum Sound Pressure Level (SPL) that the user allows in the bright zone 110*a*, $\psi_G$ denotes the WPM weighting factor for the grey zone 110*c*, which is in the range $0\leq\psi_G<1$ and preferably set to a very low value, such as $0.01\leq\psi_G<0.1$, and $\psi_D$ denotes the WPM weighting factor for the dark zone 110*b*, which is in the range $0<\psi_D\leq1$. It is the value by means of which the directivity/quality trade-off is controlled according to embodiments of the disclosure.

The solution to the above problem is $$q=(z_B^H z_B+\psi_D Z_D^H Z_D+\psi_G Z_G^H Z_G+\beta I)^{-1} z^*_B \hat{p}_B. \tag{9}$$

In an embodiment, the regularization factor β can be calculated by means of the Normalized Tikhonov regularization (NTR) method, which is disclosed, for instance, in the article by Shin et al, and is then stored in the memory 103 of the apparatus 100. The regularization factor can be calculated as $$\beta=\beta_0\sigma_1^2, \tag{10}$$

wherein $\sigma_1$ is the largest singular value of the transfer matrix Z and $\beta_0$ is a positive real-valued factor. Computing the value of the regularization factor in advance and storing it in the memory 103 reduces the system complexity for the calculation of $\psi_D$ and, hence, for the calculation of the transducer driving signals. Calculations of the parameter $\beta_0$ depend on the geometry of the array of loudspeakers 107A-L, control point configuration, and requirement to limit the input energy and can be calculated by following the procedure outlined in Shin et al. The value of β can be calculated with the following formula (see Appendix A of Shin et al):

$$20\log_{10}(\|q_{PMM}\|)\leq 20\log_{10}\left(\frac{\sqrt{M_B}}{2\sigma_1}\right)-10\log_{10}(\beta_0), \tag{11}$$

where $\beta_0$ can be used to control the input energy to the array of loudspeakers 107A-L. The filters can be calculated on a per-frequency basis in the frequency range $[0,f_s/2]$, where $f_s=48$ denotes the sampling frequency that is divided into $N_{FFT}/2+1$ frequency bins with uniform frequency spacing, and $N_{FFT}=8192$. In an embodiment, a modeling delay may be applied to ensure that the filters are causal.

By assigning a high value of the WPM weight to a given zone, one obtains a higher accuracy of reproduction of the target signal in that zone. Thus, in order to ensure quality at the listener's position, in an embodiment, a large WPM weight (e.g., the maximum possible value, i.e. $\psi_B=1$) can be given to the bright zone 110*a*, and a small value $\psi_G$ set by the user, to the grey zone 110*c*, as no accurate reproduction of the target signal is required in the grey zone 110*c*. Control points in the grey zone 110*c* can be used to relax the constraint in the zones where no accurate reproduction is desired. For a given value of the regularization factor β the user can control the trade-off between directivity and quality by setting the value of $|p_{B,min}|^2$. The control unit 101 is configured to determine, in response to the user's setting, the value of $\psi_D$ so that the filters satisfy the performance constraint. In other words, by trying and adjusting $\psi^D$ the control unit 101 can ensure that the energy in the bright zone 110*a* is at least $|p_{B,min}|^2$. The energy loss can be expressed in dB as:

$$|p_{B,min}|_{dB}=20\log_{10}\left(\left|\frac{p_{B,min}}{\hat{p}_B}\right|\right). \tag{12}$$

Embodiments of the disclosure use an iterative algorithm for the calculation of the optimal WPM weight with respect to a given performance constraint, which is shown in FIG. 2. Very briefly, the algorithm shown in FIG. 2, which according to embodiments of the disclosure is implemented in the control unit 101 of the apparatus 100, first determines a solution q for the case $\psi_D=1$ and then iteratively reduces $\psi_D$ as long as the corresponding new solutions q still satisfy the constraint defined in equation (8).

On the basis of the WPM method described above, embodiments of the apparatus 100 can be used in a variety of settings and applications, hereafter referred to as use-case scenarios, the latter being defined by a given listener/control-zone configurations (i.e., changes in the plant matrices $Z_B$, $Z_D$ and $Z_G$) and given performance constraints (i.e., choice of $|p_{B,min}|^2$) to meet the quality requirements set by the user. This can be achieved by accurate reproduction of the sound field at the control points, where people are located (either in the bright or dark zones) while the zones that are not occupied are labeled as grey zones. By combining these types of zones, three major use-case scenarios can be defined that account for different usages of the apparatus 100, such as audio reproduction, private communication, and the like. Embodiments of the disclosure use the grey zone(s) 110*c*, i.e. the plant matrix $Z_G$, because, in practice, there may be portions of the control zone 110 that are not occupied by other people and hence no accurate reproduction is required (hence, the control unit 101 can select a low $\psi_G$). In an embodiment, the matrix Z can be pre-calculated for a set of M control points (e.g., using analytical models) and stored in the memory 103 of the apparatus 100. Then, a labeling of each control point can be performed by obtaining the position of the listener and the other people by means of a video tracking device or a mobile phone app.

Figure 3:
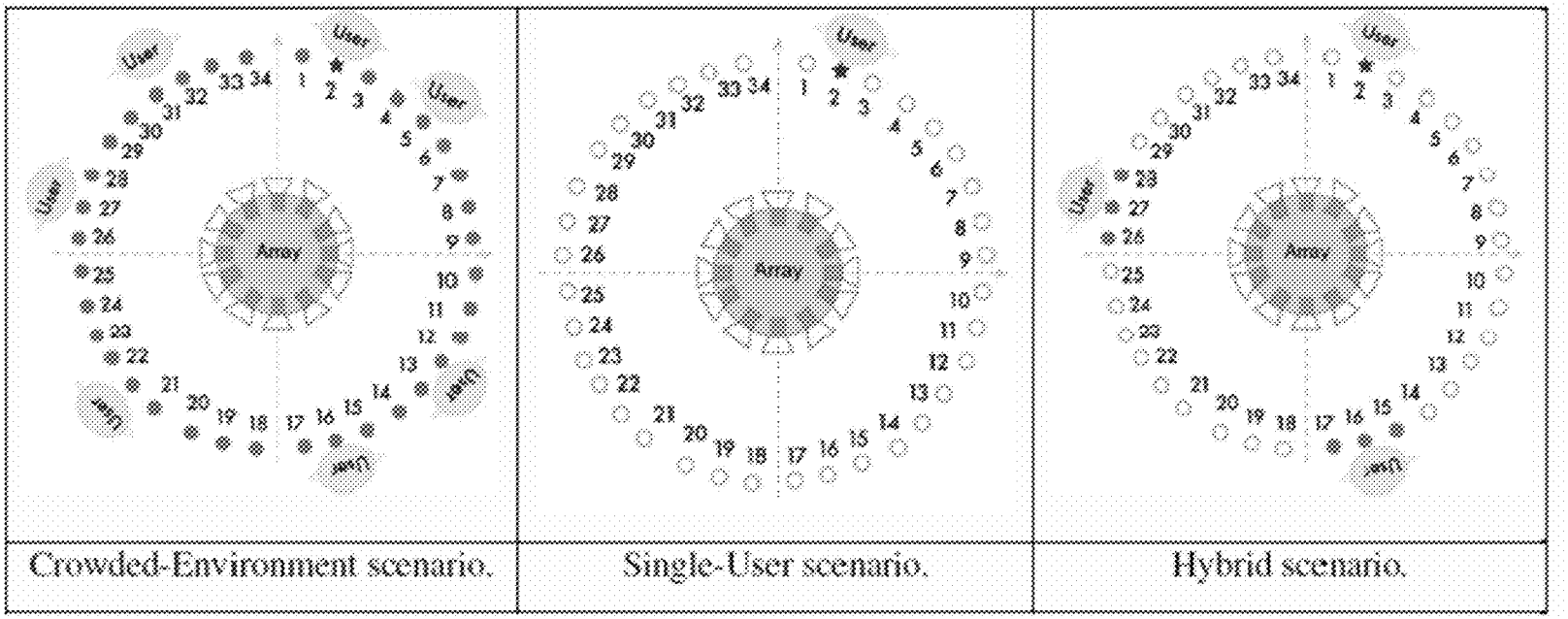
FIG. 3 shows three exemplary sound field scenarios, which can be generated by an apparatus for generating a sound field according to an embodiment.

With reference to FIG. 3, the following use-case scenarios based on various combinations of the above-defined types of sound zones can be handled by embodiments of the apparatus 100.

In the "Crowded-Environment scenario", shown on the left hand side of FIG. 3, the listener (located at control point #2 in the example of FIG. 3) is located in a crowded environment where other people are present. The position of the other people is likely to vary with time (e.g., the apparatus 100 is operating in a public space). In this case, the SPL is minimized in the whole control zone 110 but the listening point. In this case, the control unit 101 can be configured to determine the transducer driving signals on the basis of the following equation:

$$q=(z_B^H z_B+\psi_D Z_D^H Z_D+\beta I)^{-1} z^*_B \hat{p}_B. \tag{13}$$

In the "Single-user scenario", shown in the middle of FIG. 3, the user is alone in the environment and there are no requirements for directivity performance. In this case, the user may want to use the apparatus 100 for audio reproduction and thus the objective is to preserve "audio quality". From a technical point of view, this is a combination of grey and bright points. In this case, the control unit 101 can be configured to determine the transducer driving signals on the basis of the following equation:

$$q=(z_B^H z_B+\psi_G Z_G^H Z_B+\beta I)^{-1} z^*_B \hat{p}_B. \tag{14}$$

In the "Hybrid scenario", shown on the right hand side of FIG. 3, a single listener is located in an environment where several people are present. The zones that are not occupied by users are labeled as grey zones. This is a combination of grey, dark, and bright points. In this case, the control unit 101 can be configured to determine the transducer driving signals on the basis of equation (9) above.

As the algorithm shown in FIG. 2 can under certain circumstances be time consuming and computationally demanding, especially for real-time implementation, embodiments of the disclosure use a different algorithm allowing to calculate the values of $\psi_D$ in a more efficient way.

Given a scenario and assuming that the listener wants to set a desired directivity and quality trade-off (i.e., by setting a value for $|p_{B,min}|^2$), embodiments of the disclosure consider a set of filters $q(\psi_D=0.5)$ calculated on the basis of equation (9). Embodiments of the disclosure allow to compute the filters $q(\psi_D=0.5)$ once when the scenario is set and update this set of filters every time the user sets a new value of $|p_{B,min}|^2$. Hence, embodiments of the disclosure allow finding a new set of filters $\tilde{q}=q(0.5+\Delta\psi_D)$ that satisfies the constraint on $|p_{B,min}|^2$, wherein $\Delta\psi_D$ is the value of the tunable parameter that should be selected so that $\tilde{q}=q(0.5+\Delta\psi_D)$ satisfies the performance constraint. Using an approximated Neumann series one can write (as will be outlined in more detail further below):

$$\tilde{q} \approx \tilde{q}_N = \sum_{n=0}^{N} \Delta\psi_D^n E^n q(\psi_D = 0.5), \tag{15}$$

where $\tilde{q}_N$ is the approximated set of filters (i.e. transducer driving signals), N is the number of terms of the Neumann series or order and $E=(z_B^H z_B+0.5 Z_D^H Z_D+\psi_G Z_G^H Z_G+\beta I)^{-1} Z_D^H Z_D$. In other words, embodiments of the disclosure allow to update a stored set of filters $q(\psi_D=0.5)$ to some modified set of filters $\tilde{q}=q(0.5+\Delta\psi_D)$ that satisfies the constraint on $|p_{B,min}|^2$.

The accuracy of approximation depends on the value of N. By truncating the Neumann series to a given order N, errors between the nominal filters $\tilde{q}$ and the approximated ones $\tilde{q}_N$ are introduced (calculated with the truncated Neumann series). These errors depend on N, as well as the values of $\Delta\psi_D$ and on frequency. The error between the two sets of filters can be defined as $$\varepsilon = 10\log_{10}\left(\frac{\|\tilde{q}_N - \tilde{q}\|^2}{\|\tilde{q}\|^2}\right), \tag{16}$$

where the filters $\tilde{q}$ be calculated with equation (9) and $\tilde{q}_N$ are the filters calculated with the approximation in equation (15). According to embodiments of the disclosure, the order N of the Neumann series is a frequency-dependent parameter, which can reduce the computational load. More specifically, in an embodiment, the chosen $N(\omega)$ decreases as frequency increases. It can be calculated for the filters calculated with the CE scenario (that can be considered as a reference, worst-case, scenario) by setting $\psi_D=0.5$ and $\Delta\psi_D=0.5$. According to embodiments of the disclosure, the selected value of N (for a given frequency) is $$N = \min_N\{\varepsilon \le \varepsilon_{MAX}\}, \tag{17}$$

wherein $\varepsilon_{MAX}$ is an error threshold (in dB) set by the user (typically very low value e.g., $\varepsilon_{MAX}=0.001$ dB). This value of N can be stored in the memory 103 of the apparatus 100 and used by the control unit 101 for all the various scenarios. The pseudo-code of the algorithm described above, which according to embodiments of the disclosure is implemented in the control unit 101 of the apparatus 100, is shown in FIG. 4.

To summarize, given a set of reference filters $q(\psi_D=0.5)$ calculated and stored into the memory 103 of the apparatus 100, the Neumann Series allows for the approximation $\tilde{q}_N$ of the new filters $\tilde{q}=q(\psi_D+\Delta\psi_D)$. From a practical point of view, the main characteristic of equation (15) is that the parameter $\Delta\psi_D$ (that is to be determined) is a multiplication factor. Since the dependence of the filters $\tilde{q}_N$ on the parameter $\Delta\psi_D$ has been simplified, embodiments of the disclosure allow finding an estimation of the value $\Delta\psi_D$, say $\overline{\Delta\psi_D}$, so that the new set of filters $\tilde{q}_N(\overline{\psi_D})=\tilde{q}_N(\psi_D+\overline{\Delta\psi_D})$ satisfies the quality constraint, that is $$|z_B^T \tilde{q}_N|^{2\approx}|p_{B,min}|^2. \tag{18}$$

For a given order N (large enough) and given q, according to embodiments of the disclosure the value of $\overline{\Delta\psi_D}$ is found by finding the roots of the following polynomial $$\sum_{n=0}^{N} |\Delta\psi_d|^n |z_B^T E^n q| - |p_{B,min}| = 0,\ -0.5 \le \Delta\psi_D \le 0.5, \tag{19}$$

which will be described in more detail further below. The final value of $\psi_D$ is calculated as $\psi_D=0.5\pm|\overline{\Delta\psi_D}|$. The corresponding algorithm for the estimation of $\Delta\psi_D$, which according to embodiments of the disclosure is implemented in the control unit 101 of the apparatus 100 is shown in FIG. 5.

As already mentioned above, the embodiments described above may be extended to other array geometries and configurations of control points. In general, the WPM method implemented in embodiments of the disclosure requires the knowledge of the transfer function matrix Z. This matrix can be generated for arbitrary array geometries and arbitrary distributions of control points.

Figure 6:
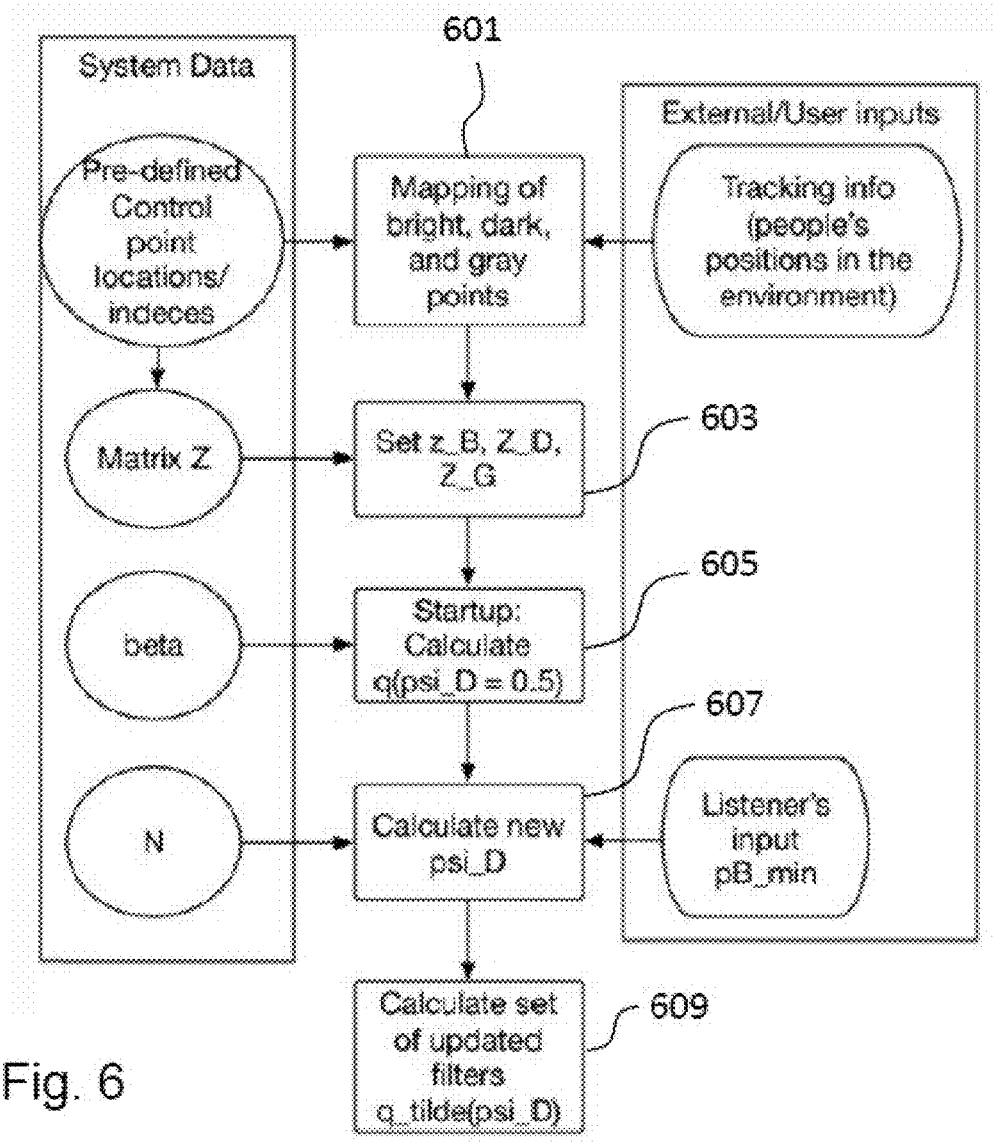
FIG. 6 shows a flow chart illustrating different aspects of an apparatus for generating a sound field according to an embodiment.

FIG. 6 shows a flow chart illustrating different processing steps in the apparatus 100 according to an embodiment, which already have been described above. The mapping of bright, grey, and dark points in step 601 is the operation of labelling of the control points depending on the position of the listener (bright zone), other people (dark zones), or unoccupied zones (grey zones). In step 603 the transfer matrix or matrices are provided. Steps 605, 607 and 608 related to the steps of determining the original filters, the adjustment of the dark zone weighting parameter and the updated filters, which have already been described above.

Figure 7:
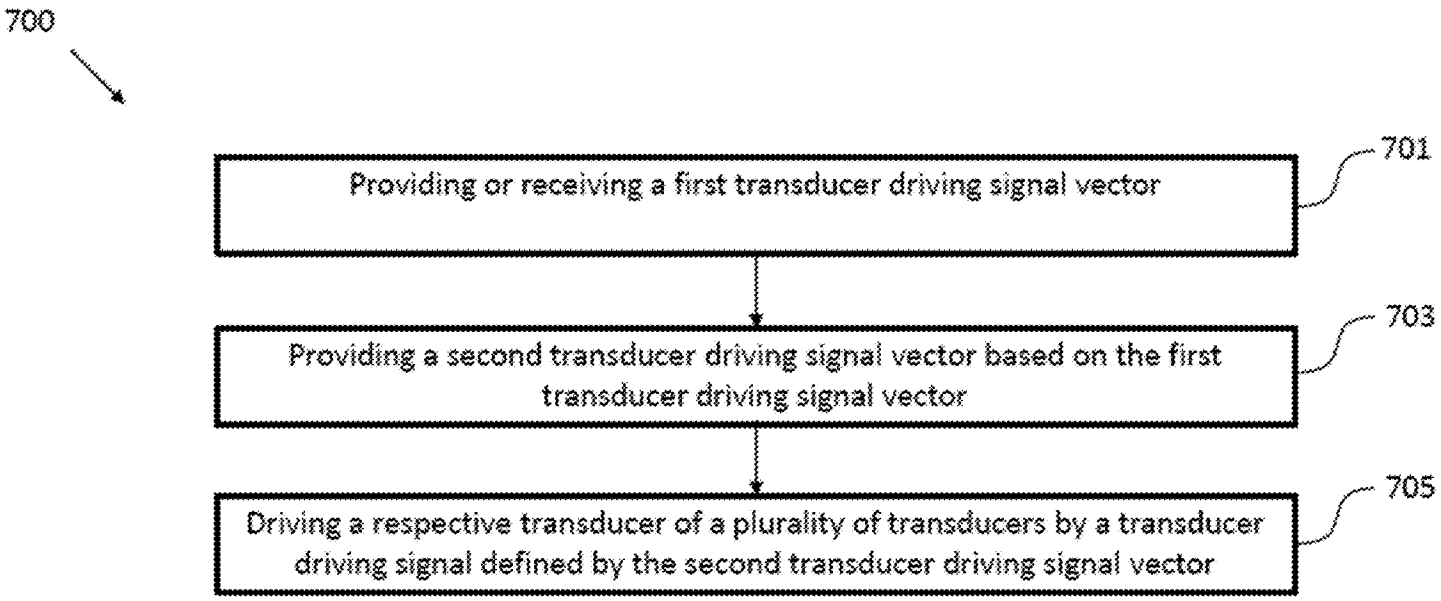
FIG. 7 shows a schematic diagram of a method for generating a sound field according to an embodiment.

FIG. 7 shows a schematic diagram of a method 700 for generating a sound field according to an embodiment. The method 700 comprises the steps of: providing or receiving 701 a first transducer driving signal vector $q_0$ of dimension L such that the gradient of $J(q;\psi)$ with respect to q is zero in $(q_0;\psi_0)$, wherein $J(q;\psi)$ is a cost function having as variables a transducer driving signal vector q of dimension L and a weight matrix $\psi$ of dimension M×M, and wherein $\psi_0$ is a first weight matrix of dimension M×M; providing 703 a second transducer driving signal vector $\tilde{q}$ of dimension L such that the gradient of the cost function $J(q;\psi)$ with respect to q is zero in $(\tilde{q};\tilde{\psi})$, wherein $\tilde{\psi}$ is a second weight matrix of dimension M×M, and wherein the second transducer driving signal vector $\tilde{q}$ is provided on the basis of: the first transducer driving signal vector $q_0$, the first weight matrix $\psi_0$, and the second weight matrix $\psi$; and driving 705 a respective transducer of a plurality of transducers by a respective transducer driving signal defined by the second transducer driving signal vector $\tilde{q}$.

As already mentioned above, the embodiments of the disclosure can also be applied to a scenario in which the same audio channel is provided to two or more bright zones that are distant from each other. The pressure $p_B$ then becomes a vector $p_B$. For example, two bright zones may be located on opposite sides of the array of loudspeakers 107A-L.

In a multi-channel system, two beams belonging to two different audio channels can be superimposed. It is, thus, possible to deliver different audio content to the different bright points. Different filters can be used, one filter for each beam.

In the following some more mathematical details about the above equations will be described. Let us consider a given scenario and assume that the listener wants to set a desired directivity and quality trade-off (i.e., by setting a value for $|p_{B,min}|^2$). Let us consider a set of filters $q(\psi_D=0.5)$, that is $$q(\psi_D=0.5)=(z_B^H z_B+0.5Z_D^H Z_D+\psi_G Z_G^H Z_G+\beta I)^{-1} z^*_B \hat{p}_B, \tag{20}$$

that are calculated as soon as the scenario is set and that are stored in the memory 103 of the apparatus 100. Note that filters $q(\psi_D=0.5)$ may not satisfy the performance constraint on $|p_{B,min}|^2$. If that is the case, then the goal is to find a new set of filters $\tilde{q}$ that satisfies the performance constraint, where $$\tilde{q}=q(0.5+\Delta\psi_D)=(z_B^H z_B+0.5Z_D^H Z_D+\Delta\psi_D Z_D^H Z_D+\psi_G Z_G^H Z_G+\beta I)^{-1} z^*_B \hat{p}_B, \tag{21}$$

and $-0.5\leq\Delta\psi_D\leq 0.5$. Using the following definitions $$A=z_B^H z_B+0.5Z_D^H Z_D+\psi_G Z_G^H Z_G+\beta I,$$

$$b=z^*_B \hat{p}_B, \tag{22}$$

$$C=\Delta\psi_D Z_D^H Z_D,$$

equations (20) and (21) can be written as follows:

$$q=q(0.5)=A^{-1}b, \tag{23}$$

and $$\tilde{q}=q(0.5+\Delta\psi_D)=(A+C)^{-1}b=B^{-1}b, \tag{24}$$

wherein B=A+C. If the matrix B is close to an invertible matrix X, i.e. satisfying the relation $$\lim_{n\to\infty}(I-X^{-1}B)=0 \text{ or } \lim_{n\to\infty}(I-BX^{-1})=0, \tag{25}$$

it can be shown that the following relation holds $$B^{-1}=\sum_{n=0}^{\infty}(X^{-1}(X-B))^n X^{-1}. \tag{26}$$

Let us choose X=A, and since A is an invertible matrix, X is also invertible. Hence, the Neumann series in equation (26) can be written as follows:

$$B^{-1}=\sum_{n=0}^{\infty}(A^{-1}(A-B))^n A^{-1}=\sum_{n=0}^{\infty}(-A^{-1}C)A^{-1}. \tag{27}$$

By substituting equation (27) into equation (24) one obtains $$\tilde{q}=\sum_{n=0}^{\infty}(-A^{-1}C)^n \underbrace{A^{-1}b}_{=q(\psi_D=0.5)}=\sum_{n=0}^{\infty}(-A^{-1}C)^n q(\psi_D=0.5). \tag{28}$$

The above equation (28) suggests that the updated set of filters $\tilde{q}$ can be updated using the reference set q and, most noticeably, no matrix inversion is required for the calculation of $\tilde{q}$. In fact, $A^{-1}$ (as well as C) are computed at the time of the calculation of the reference set q. The Neumann Series above consists of an infinite series of terms, and cannot be implemented in practice. Let us set $E=-A^{-1}Z_D^H Z_D$. Then truncate the above summation at a given order N, that is $$\tilde{q}\approx\tilde{q}_N=\sum_{n=0}^{N}\Delta\psi_D^n E^n q, \tag{29}$$

which shows that the updated filter set $\tilde{q}$ can be approximated by $\tilde{q}_N$.

Algebraical manipulations of equation (18) leads to $$|z_B^T\tilde{q}_N|\geq|p_{B,min}|. \tag{30}$$

Using the triangular inequality for two vector norms for two vectors X and y, i.e. $\|x+y\|\leq\|x\|+\|y\|$, equation (15) yields $$|z_B^T\tilde{q}_N|\leq\sum_{n=0}^{N}|\Delta\psi_D|^n|z_B^T E^n q|. \tag{31}$$

Equation (31) contains a polynomial of degree N, where the unknown is $\Delta\psi_D$. By taking into account equations (30) and (31) one can write $$|p_{B,min}|\leq|z_B^T\tilde{q}_N|\leq\sum_{n=0}^{N}|\Delta\psi_D|^n|z_B^T E^n q|, \tag{32}$$

from which one can infer $$|p_{B,min}| \leq \sum_{n=0}^{N} |\Delta\psi_D|^n |z_B^T E^n q|. \tag{33}$$

For a given order N (large enough) and given q, an estimate of the value of $|\Delta\psi_D|$ can be found by solving the following equation:

$$\sum_{n=0}^{N} |\Delta\psi_d|^n |z_B^T E^n q| - |p_{B,min}| = 0, \; -0.5 \leq \Delta\psi_D \leq 0.5, \tag{34}$$

Hence, by finding the roots of the polynomial, one obtains an estimation of $|\Delta\psi_D|$. The equation above can be simplified in the following way:

$$f(x) = \sum_{n=1}^{N} a_n x^n + a_0 - c_0 = 0, \tag{35}$$

wherein $x=|\Delta\psi_D|$ and $a_n=|z_B{}^T E^n q|$, $a_n \geq 0 \forall n$, and $c_0=|p_{B,min}|$. Some notes about the polynomial f(x): $a_n$ are all positive, the domain of x is compact and in order to make sure that there is at least one real root of f(x), N must be odd. If a given value of N (determined on the basis of the algorithm shown in FIG. 4) at a given frequency is even, then according to embodiments of the disclosure the control unit 101 is configured to increase N by one, that is $$N=N+1, \text{ if } N \text{ is even}$$

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

Although specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the embodiment of the disclosure beyond those described herein. While the embodiment of the disclosure has been described with reference to one or more particular embodiments, those skilled in the art recognize that many changes may be made thereto without departing from the scope of the embodiment of the disclosure. It is therefore to be understood that within the scope of the appended claims and their equivalents, the embodiment of the disclosure may be practiced otherwise than as specifically described herein.

What is claimed is:

1. An apparatus for generating a sound field on the basis of an input audio signal, wherein the apparatus comprises:

a plurality of transducers, wherein each transducer of the plurality of transducers is configured to be driven by a transducer driving signal $q_l$ of the respective transducer, wherein $l \in \{1, \ldots, L\}$ and wherein l denotes the l-th transducer;

a plurality of filters configured to generate for each transducer of the plurality of transducers the transducer driving signal $q_l$ of the respective transducer, wherein each of the filters of the plurality of filters is defined by a filter transfer function and wherein the transducer driving signal $q_l$ of the respective transducer is based on the filter transfer function of the respective transducer and the input audio signal; and a control unit configured to provide or receive a first transducer driving signal vector $q_0$ of dimension L such that a gradient of $J(q;\psi)$ with respect to q is zero in $(q_0;\psi_0)$, wherein $J(q;\psi)$ is a cost function having as variables a transducer driving signal vector q of dimension L and a weight matrix $\psi$ of dimension M×M, and wherein $\psi_0$ is a first weight matrix of dimension M×M, wherein the control unit is further configured to provide a second transducer driving signal vector q of dimension L such that a gradient of the cost function $J(q;\psi)$ with respect to q is zero or approximately zero in $(\tilde{q}; \tilde{\psi})$, wherein $\tilde{\psi}$ is a second weight matrix of dimension M×M, and wherein the control unit is configured to provide the second transducer driving signal vector $\tilde{q}$ on the basis of:

the first transducer driving signal vector $q_0$, the first weight matrix $\psi_0$, and the second weight matrix $\tilde{\psi}$, wherein the cost function is $J(q;\psi)=\|\hat{\psi}(\hat{p}-p)\|^2+\beta\|q\|^2$, wherein $\hat{p}$ is a target pressure vector of dimension M comprising M target pressure values $\hat{p}_m$ for a set of M control points, $m \in \{1, \ldots, M\}$, p is a pressure vector of dimension M comprising M pressure values $p_m$ for the set of M control points, $m \in \{1, \ldots, M\}$, and is a regularization parameter in the range of $[0,\infty)$.

2. The apparatus of claim 1, wherein the control unit is configured to compute the second transducer driving signal vector $\tilde{q}$ on the basis of a truncated Neumann series of order N as $$\tilde{q}=\Sigma_{n=0}^{N}(-(Z^H\psi_0 Z+\beta I)^{-1}Z^H\Delta\psi Z)^n(q_0+(Z^H\psi_0 Z+\beta I)^{-1}Z^H\Delta\psi\hat{p}),$$

wherein Z is a transfer matrix of dimension M×L, I is the identity matrix of dimension L×L, $\Delta\psi$ denotes the difference between $\psi_0$ and $\tilde{\psi}$ and the superscript $^H$ denotes Hermitian transposition.

3. The apparatus of claim 2, wherein the sound field comprises an acoustically bright zone, an acoustically dark zone and an acoustically grey zone and wherein the cost function J(q;ψ) is given by the following equation:

$$\|p_B-\bar{p}_B\|^2+\psi_D\|p_D\|^2+\psi_G\|p_G\|^2+\beta\|q\|^2,$$

and wherein the gradient of J(q;ψ) with respect to q is zero in $(q_0;\psi_0)$ under the constraint that $|\Sigma_{l=1}^{L} Z_{ml}q_l|^2=|p_m|^2|p_{m,min}|^2$ for each m E B where B is the set of indices of control points in the bright zone and $|p_{m,min}|^2$ is a positive real number associated with the respective desired minimum level of sound energy at a respective control point in the bright zone, wherein $P_B$ denotes a sound pressure at a control point in the bright zone, $\bar{p}_B$ denotes a desired sound pressure at the control point in the bright zone, $p_D$ denotes a respective sound pressure at a plurality of control points in the dark zone, $p_G$ denotes a respective sound pressure at a plurality of control points in the grey zone, $Z_{ml}$ denotes the element in the m-th row and the l-th column of the transfer matrix Z $\psi_D$ denotes a dark zone weighting parameter, $\psi_G$ denotes a grey zone weighting parameter and $P_{B,min}$ denotes a desired minimum level of sound energy at the control point in the bright zone.

4. The apparatus of claim 3, wherein the control unit is configured to provide the second transducer driving signal vector $\tilde{q}$ in response to an adjustment of the desired minimum level of sound energy at the control point in the bright zone.

5. The apparatus of claim 3, wherein the truncated Neumann series of order N is defined by the following equation:

$$\Sigma_{n=0}^{N}\Delta\psi_D{}^n E^n,$$

wherein $\Delta\psi_D$ denotes an adjustment of the dark zone weighting parameter $\psi_D$ and wherein the matrix E is defined by the following equation:

$$E=-A^{-1}Z_D{}^H Z_D,$$

wherein the matrix A is defined by the following equation:

$$A=Z_B{}^H Z_B+\psi_D Z_D{}^H Z_D+\psi_G Z_G{}^H Z_G+\beta I,$$

wherein $Z_B$ denotes the transfer matrix for the bright zone, $Z_D$ denotes the transfer matrix for the dark zone, and $Z_G$ denotes the transfer matrix for the grey zone.

6. The apparatus of claim 5, wherein the control unit is configured to determine the adjustment $\Delta\psi_D$ of the dark zone weighting parameter $\psi_D$ by determining the root of the following equation within the interval $-0.5\leq\Delta\psi_D\leq 0.5$:

$$\Sigma_{n=0}^{N}|\Delta\psi_D|^n|z_B{}^T E^n q|-|p_{B,min}|=0,$$

wherein $z_B{}^T$ denotes portion of the transfer matrix defining a vector and $p_{B,min}$ denotes a desired minimum level of sound energy at the control point in the bright zone.

7. The apparatus of claim 2, wherein the order N of the truncated Neumann series depends on frequency.

8. The apparatus of claim 7, wherein the order N of the truncated Neumann series decreases with increasing frequency.

9. The apparatus of claim 7, wherein the control unit is configured to determine the order N of the truncated Neumann series on the basis of the following equation:

$$N=\min_N\{\varepsilon\leq\varepsilon_{MAX}\},$$

wherein $\varepsilon_{MAX}$ denotes an error threshold and ε denotes an error measure defined by the following equation:

$$\varepsilon=10\log_{10}\left(\frac{\|\tilde{q}_N-\tilde{q}\|^2}{\|\tilde{q}\|^2}\right),$$

wherein $\tilde{q}_N$ denotes the transducer driving signal vector determined on the basis of the truncated Neumann series.

10. The apparatus of claim 1, wherein the first transducer driving signal vector $q_0$ is $$q_0=(Z^H\psi_0 Z+\beta I)^{-1}Z^H\psi_0\bar{p},$$

wherein Z is a transfer matrix of dimension M×L.

11. The apparatus of claim 1, wherein the control unit is configured to determine the regularization factor β on the basis of a normalized Tikhonov regularization.

12. The apparatus of claim 1, wherein the apparatus further comprises a memory configured to store the first transducer driving signal vector $q_0$.

13. A method for generating a sound field on the basis of an input audio signal, wherein the method comprises the steps of:

providing or receiving a first transducer driving signal vector $q_0$ of dimension L such that a gradient of J(q;ψ) with respect to q is zero in $(q_0;\psi_0)$, wherein J(q;ψ) is a cost function having as variables a transducer driving signal vector q of dimension L and a weight matrix ψ of dimension M×M, and wherein $\psi_0$ is a first weight matrix of dimension M×M;

providing a second transducer driving signal vector $\tilde{q}$ of dimension L such that a gradient of the cost function J(q;ψ) with respect to q is zero in $(\tilde{q};\tilde{\psi})$, wherein $\tilde{\psi}$ is a second weight matrix of dimension M×M, and wherein the second transducer driving signal vector $\tilde{q}$ is provided on the basis of:

the first transducer driving signal vector $q_0$, the first weight matrix $\psi_0$, and the second weight matrix $\tilde{\psi}$; and driving each transducer of a plurality of L transducers by a respective component $\tilde{q}_l$, $l\in\{1,\ldots,L\}$, of the second transducer driving signal vector $\tilde{q}$;

wherein the cost function is $J(q;\psi)=\|\tilde{\psi}(\bar{p}-p)\|^2+\beta\|q\|^2$, wherein $\bar{p}$ is a target pressure vector of dimension M comprising M target pressure values $\bar{p}_m$ for a set of M control points, $m\in\{1,\ldots,M\}$, p is a pressure vector of dimension M comprising M pressure values $p_m$ for the set of M control points, $m\in\{1,\ldots,M\}$, and β is a regularization parameter in the range of $[0,\infty)$.

14. A non-transitory storage medium carrying a program code which when executed by one or more processors of a computer causes the computer to perform a method of generating a sound field on the basis of an input audio signal, wherein the method comprises the steps of:

providing or receiving a first transducer driving signal vector $q_0$ of dimension L such that a gradient of J(q;ψ) with respect to q is zero in $(q_0;\psi_0)$, wherein J(q;ψ) is a cost function having as variables a transducer driving signal vector q of dimension L and a weight matrix ψ of dimension M×M, and wherein $\psi_0$ is a first weight matrix of dimension M×M;

providing a second transducer driving signal vector $\tilde{q}$ of dimension L such that a gradient of the cost function J(q;ψ) with respect to q is zero in $(\tilde{q};\tilde{\psi})$, wherein $\tilde{\psi}$ is a second weight matrix of dimension M×M, and wherein the second transducer driving signal vector $\tilde{q}$ is provided on the basis of:

the first transducer driving signal vector $q_0$, the first weight matrix $\psi_0$, and the second weight matrix $\tilde{\psi}$; and driving each transducer of a plurality of L transducers by a respective component $\tilde{q}_l$, $l \in \{1, \ldots, L\}$, of the second transducer driving signal vector $\tilde{q}$;

wherein the cost function is $J(q;\psi)=\|\tilde{\psi}(\bar{p}-p)\|^2+\beta\|q\|^2$, wherein $\bar{p}$ is a target pressure vector of dimension M comprising M target pressure values $\bar{p}_m$ for a set of M control points, $m \in \{1, \ldots, M\}$, p is a pressure vector of dimension M comprising M pressure values $P_m$ for the set of M control points, $m \in \{1, \ldots, M\}$, and $\beta$ is a regularization parameter in the range of $[0,\infty)$.

* * * * *